US007443350B2

(12) United States Patent
Gaucher et al.

(10) Patent No.: US 7,443,350 B2
(45) Date of Patent: Oct. 28, 2008

(54) EMBEDDED MULTI-MODE ANTENNA ARCHITECTURES FOR WIRELESS DEVICES

(75) Inventors: Brian P. Gaucher, Brookfield, CT (US); Duixian Liu, Scarsdale, NY (US); Thomas R. Hildner, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 195 days.

(21) Appl. No.: 11/482,571

(22) Filed: Jul. 7, 2006

(65) Prior Publication Data

US 2008/0007465 A1 Jan. 10, 2008

(51) Int. Cl.
*H01Q 1/24* (2006.01)

(52) U.S. Cl. ..... 343/702; 343/700 MS; 343/773; 343/846

(58) Field of Classification Search ..... 343/700 MS, 343/702, 829, 846, 795, 773
See application file for complete search history.

(56) References Cited

U.S. PATENT DOCUMENTS

| | | | | |
|---|---|---|---|---|
| 5,926,150 | A | 7/1999 | McLean et al. | 343/846 |
| 6,018,324 | A | 1/2000 | Kitchener | 343/795 |
| 6,661,380 | B1 * | 12/2003 | Bancroft et al. | 343/700 MS |
| 6,781,546 | B2 * | 8/2004 | Wang et al. | 343/700 MS |
| 7,015,868 | B2 | 3/2006 | Puente Baliarde et al. | 343/800 |
| 7,095,374 | B2 * | 8/2006 | Chen et al. | 343/702 |
| 7,176,837 | B2 * | 2/2007 | Sonoda et al. | 343/700 MS |
| 7,187,331 | B2 * | 3/2007 | Chen et al. | 343/702 |
| 7,330,158 | B2 * | 2/2008 | Harihara | 343/795 |
| 2005/0140553 | A1 | 6/2005 | Kuramoto | 343/702 |
| 2005/0156804 | A1 | 7/2005 | Ratni et al. | 343/773 |
| 2005/0233786 | A1 | 10/2005 | Hatch | |
| 2006/0164305 | A1 | 7/2006 | Chen | |

FOREIGN PATENT DOCUMENTS

| | | |
|---|---|---|
| WO | WO03088417 | 10/2003 |

OTHER PUBLICATIONS

Notification of Transmittal of the International Search Report and the Written Opinion of the International Searching Authority, or the Declaration. International Application No. PCT/EP2007/056051; International Filing Date: Jun. 19, 2007.

* cited by examiner

*Primary Examiner*—Tho G Phan
(74) *Attorney, Agent, or Firm*—F. Chau & Associates, LLC

(57) ABSTRACT

Low-profile, compact embedded multi-mode antenna designs are provided for use with computing devices, such as laptop computers, which enable ease of integration within computing devices with limited space, while providing suitable antenna characteristics (e.g., impedance matching and radiation efficiency) over an operating bandwidth of about 0.8 GHz to about 11 GHz.

35 Claims, 9 Drawing Sheets

EMBEDDED MULTI-MODE ANTENNA ARCHITECTURES FOR WIRELESS DEVICES

TECHNICAL FIELD OF THE INVENTION

The present invention relates generally to low-profile, compact embedded antenna designs for wireless devices, which support wireless connectivity and communication for multiple wireless application modes. More specifically, the present invention relates to low-profile, embedded multi-mode antenna designs that enable ease of integration within wireless devices with limited space, while providing suitable antenna characteristics and performance for wideband operation over multiple wireless application standards.

BACKGROUND

The increasing market demand for wireless connectivity coupled with innovations in integrated circuit technology have motivated the development of wireless devices equipped with low cost, low power, and compact monolithic integrated radio transmitters, receivers, and transceiver systems with integrated antennas. Indeed, various types of wireless devices with embedded wireless systems have been developed to support wireless applications such as WPAN (wireless personal area network), WLAN (wireless local area network), WWAN (wireless wide area network), and cellular network applications, for example. In particular, wireless standards such as the 2.45 GHz ISM (Industrial-Scientific-Medical), WLAN 5.2/5.8 GHz, GPS (Global Positioning System) (1.575 GHz), PCS1800, PCS1900, and UMTS (1.885-2.2 GHz) systems are becoming increasingly popular for laptop computers and other portable devices. In addition, ultra-wideband (UWB) wireless systems covering 3.1 GHz-10.6 GHz band have been proposed as the next generation wireless communication standard, to increase data rate for indoor, low-power wireless communications or localization systems, especially for short-range WPAN applications. With UWB technology, wireless communication systems can transmit and receive signals with more than 100% bandwidth with low transmit power typically less than −41.3 dBm/MHz.

In general, wireless devices can be designed having antennas that are disposed external to, or embedded within, the housing of such wireless devices. For example, a portable laptop computer may have an external antenna structure mounted on a top region of a display unit of the laptop. Further, a laptop computer may have a card interface for use with a PC card having an antenna structure formed on the PC card. These and other external antenna designs, however, have many disadvantages including, e.g., high manufacturing costs, susceptibility of antenna damage, unsightly appearance of the portable device due to the external antenna, etc.

In other conventional schemes, antennas can be embedded within the device housing. For example, with portable laptop computer designs, antenna structures can be embedded within a display unit of the laptop computer. In general, embedded antenna designs are advantageous over external antenna designs in that embedded antennas reduce or eliminate the possibility of antenna damage and provide for better appearance of wireless devices. With embedded antenna designs, however, antenna performance can be adversely affected with wireless device housings having limited space and lossy environments. For instance, antennas that are embedded in the display unit of a laptop computer can experience interference from surrounding metallic components such as a metal display cover, a metallic frame of a display panel, etc, or other lossy materials in proximity to the embedded antenna structure, and must be disposed away from such objects and material.

As computing devices are made smaller with increasingly limited space, embedded antennas must be designed with more compact structures and profiles, while maintaining sufficient antenna performance. The ability to construct such antennas is not trivial and can be problematic, especially when antennas must be designed for wideband, multi-mode wireless applications. Indeed, although multi-band antennas can be designed with a plurality of separate radiating elements to enable operation over multiple operating bands, the ability to achieve suitable antenna performance over the different operating bands often requires relatively large size multi-band antenna structures, which may not meet the space constraints within the laptop computers or other wireless devise. This has motivated the need for low-profile, compact multiband, multi-standard embedded antenna frameworks, which are capable of covering a wide operating bandwidth for implementation with wireless devices to support multiple wireless systems/standards.

SUMMARY OF THE INVENTION

In general, exemplary embodiments of the invention include low-profile, embedded multi-mode antenna designs for wireless devices, which support wireless connectivity and communication for multiple wireless application modes. Exemplary embodiments of the invention include low cost, low-profile and compact embedded antenna designs that enable ease of integration within wireless devices with limited space, while providing suitable antenna characteristics and performance to support wideband operation over multiple wireless application standards.

In one exemplary embodiment of the invention, an antenna includes a planar substrate having first and second opposing substrate surfaces and first and second planar radiating elements formed on the first surface of the planar substrate. The first planar radiating element is an asymmetrically-shaped pattern having a first polygon pattern and an elongated strip pattern extending from the first polygon pattern. The first planar radiating element has a first edge that defines a part of the first polygonal pattern and a second edge that defines a part of both the first polygon pattern and the elongated strip pattern. The second planar radiating element is an asymmetrically-shaped pattern having a second polygon pattern defined in part by a first edge of the second planar radiating element. The first and second planar radiating elements are disposed on the first surface of the planar substrate such that the first edge of the first planar radiating element is adjacent to, and spaced apart from, the first edge of the second planar radiating element. The first and second planar radiating elements are sized, shaped and dimensions to provide wideband operation ranging from about 1.0 GHz to about 11 GHz to support multiple wireless standards covering frequency bands inclusive of the GPS band (1.575 GHz), the PCS bands (1.710-1.880 GHZ/1.850-1.990 GHz), the ISM bands (2.45, 5.15-5.35, and 5.47-5.825 GHZ), and the UWB (3.1-10.6 GHZ) band, with desired performance characteristics over the operating bands.

In one exemplary embodiment, the antenna is a planar discone antenna where the first planar radiating element is an asymmetrically-shaped planar disc element and the second planar radiating element is an asymmetrically-shaped planar cone element having a cone tip defined by the first edge of the second planar radiating element.

In another exemplar embodiment, the antenna is a planar bi-conical antenna where the first planar radiating element is an asymmetrically-shaped planar cone element having a first cone tip defined by the first edge of the first planar radiating element and the second planar radiating element is an asymmetrically-shaped planar cone element having a second cone tip defined by the first edge of the second planar radiating element.

In yet another exemplary embodiment of the invention, the planar substrate is a flexible substrate that is bent along at least a first bending line and a second bending line to define a first substrate portion, a second substrate portion and a third substrate portion, which are non-coplanar. The first bending line separates the first and second substrate portions and the second bending line separates the second and third substrate portions. In one embodiment, the first bending line extends through the second planar radiating element and the second bending line extends through the first planar radiating element such that the first edges of the first and second planar radiating elements are disposed in the second substrate portion. The first and second substrate portions can be disposed substantially orthogonal to each other and the second and third substrate portions can be disposed substantially orthogonal to each other. In an bent configuration, the antenna can be embedded in a display unit, where the first substrate portion is disposed between a display panel and display cover, and wherein the second substrate portion is disposed external and substantially parallel to a side wall of the display cover.

In yet another exemplary embodiment of the invention, the flexible substrate can be bent along a third bending line that extends along the second edge of the first planar radiating element to further reduce the height of the antenna structure within the laptop display unit. In addition, a metallic backplate pattern can be disposed on a second surface of the substrate and aligned to a portion of the first planar radiating element on the first surface of the planar substrate so as to provide a tuning element to compensate for interference that may be caused by a display panel in proximity to the antenna.

In other exemplary embodiments of the invention, one or more additional planar radiating elements such as a branch element, coupled element or both branch and coupled elements can be included as part of the antenna to enable operation in the 0.8/0.9 GHz band in addition to operation in the 1.5-10.6 GHz band provided by the first and second planar radiating elements.

For example, in one exemplary embodiment, an antenna includes a planar substrate having first and second opposing substrate surfaces and a first planar radiating element, a second planar radiating element, a third planar radiating element and a fourth planar radiating element formed on the first surface of the planar substrate. The first planar radiating element is an asymmetrically-shaped pattern having a first polygon pattern and an elongated strip pattern extending from the first polygon pattern. The first planar radiating element comprises a first edge, second edge and third edge that define a part of the first polygonal pattern, and a fourth edge that defines a part of both the first polygon pattern and the elongated strip pattern. The second planar radiating element is an asymmetrically-shaped pattern having a second polygon pattern defined in part by a first edge of the second planar radiating element. The first and second planar radiating elements are disposed on the first surface of the planar substrate such that the first edge of the first planar radiating element is adjacent to, and spaced apart from, the first edge of the second planar radiating element. The third planar radiating element is an elongated branch element connected to the first planar radiating element. At least a portion of the elongated branch element is disposed adjacent to, and spaced apart from, the second edge of the first planar radiating element. The fourth planar radiating element is an elongated coupled element connected to the second planar radiating element, wherein at least a portion of the elongated coupled element is disposed adjacent to, and spaced apart from, the third edge of the first planar radiating element. In one embodiment, the elongated branch radiator can be connected to the first planar radiating element in proximity to an antenna feed point on the first radiating element.

In yet another embodiment of the invention, an antenna includes a planar substrate having first and second opposing substrate surfaces, and a first planar radiating element, a second planar radiating element, a third planar radiating element and a fourth planar radiating element formed on the first surface of the planar substrate. The first planar radiating element is an asymmetrically-shaped pattern having a first polygon pattern and an elongated strip pattern extending from the first polygon pattern, wherein the first planar radiating element comprises a first edge, second edge and third edge that define a part of the first polygonal pattern, and a fourth edge that defines a part of both the first polygon pattern and the elongated strip pattern. The second planar radiating element is an asymmetrically-shaped pattern having a second polygon pattern defined in part by a first edge of the second planar radiating element. The first and second planar radiating elements are disposed on the first surface of the planar substrate such that the first edge of the first planar radiating element is adjacent to, and spaced apart from, the first edge of the second planar radiating element. The third planar radiating element is an elongated branch element connected to the first planar radiating element, wherein at least a portion of the elongated branch element is disposed adjacent to, and spaced apart from, the second edge of the first planar radiating element. The fourth planar radiating element is an elongated coupled element connected to the second planar radiating element, wherein at least a portion of the elongated coupled element is disposed adjacent to, and spaced apart from, the third edge of the first planar radiating element. In one embodiment, the elongated branch element radiator is connected to the first planar radiating element in proximity to an antenna feed point on the first planar radiating element, and the elongated coupled element is connected to the second planar radiating element in proximity to the antenna feed point.

These and other exemplary embodiments, features and advantages of the present invention will be described or become apparent from the following detailed description of exemplary embodiments, which is to be read in connection with the accompanying drawings.

DETAILED DESCRIPTION OF EXEMPLARY EMBODIMENTS

In general, exemplary embodiments of the invention include compact embedded multi-mode antenna designs for use with computing devices such as laptop computers to enable wireless connectivity and communication. Exemplary multi-mode antenna frameworks as discussed in further detail below provide space efficient, broadband (0.8 GHZ-10.6 GHZ), multi-standard, interoperable antenna designs, which are highly suitable for laptop and other portable devices, while providing desirable antenna performance for optimal system requirements. In general, exemplary antenna frameworks according to the present invention are based on extensions to the exemplary antenna structures described in U.S. patent application Ser. No. 11/042,223, filed on Jan. 25, 2005, entitled "*Low-Profile Embedded Ultra-Wideband Antenna Architectures for Wireless Devices*", which is incorporated herein by reference, to enable even more compact, smaller profile antenna structures with increased operating bandwidth, for example.

In general, similar to those structures described in the above-incorporated patent application Ser. No. 11/042,223, exemplary multi-mode antenna designs according to the present invention are based on modified planar discone or planar bi-conical antenna frameworks to achieve compact antenna profiles with wide operating bandwidths and other suitable antenna characteristics. FIGS. 8A~8D are schematic diagrams illustrating evolution of various antenna embodiments to demonstrate design principles of low-profile multi-mode antennas according to exemplary embodiments of the invention.

Figure 8A:
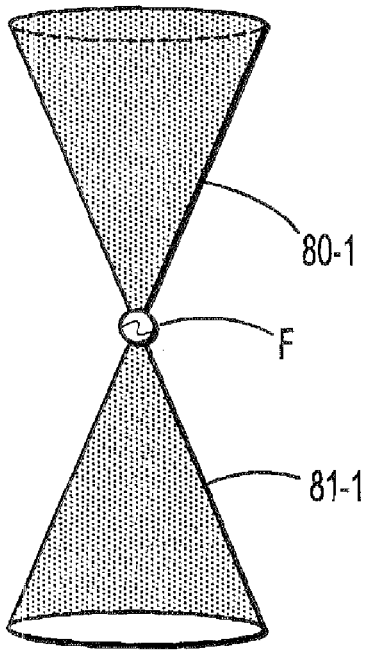
FIG. 8A (PRIOR ART)
FIGS. 8A-D are schematic diagrams illustrating an evolution of various antenna embodiments to demonstrate design principles of low-profile multi-mode antennas.
Figure 8B:
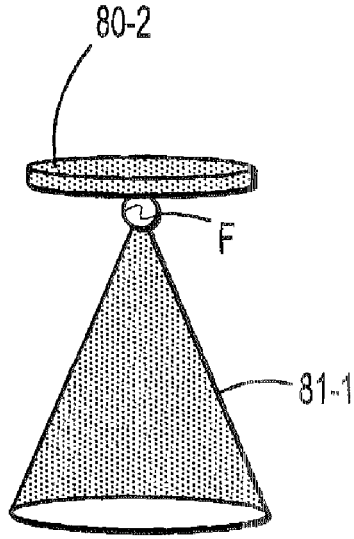
FIG. 8B (PRIOR ART)
Figure 8C:
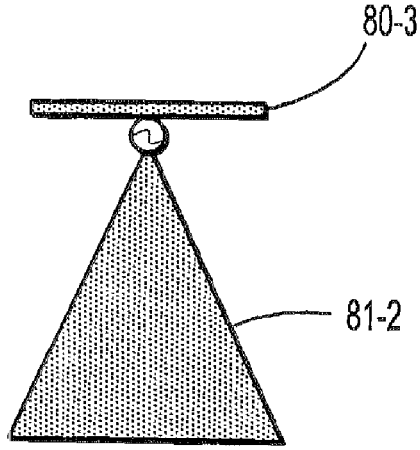
FIG. 8C (PRIOR ART)

In particular, FIG. 8A shows a three-dimensional bi-conical antenna having mirror conical elements (80-1) and (81-1) with center feed (F), which is an antenna framework known by those of ordinary skill in the art that provides broadband impedance response. In FIG. 8B, the upper cone element (80-1) of FIG. 8A can be replaced with a 3D disc element (80-2), resulting in a 3D discone antenna framework, which provides a broad bandwidth antenna structure with a lower profile. The thickness of the antenna of FIG. 8B can be reduced by modifying the antenna of FIG. 8B to form a planar discone antenna (as depicted in FIG. 8C) having a planar strip element (80-3) and planar cone element (81-2). The planar discone antenna of FIG. 8C can be implemented for laptop computer applications, for example, but due to the significant reduction in the volume of the antenna, the broadband characteristics of the antenna are degraded.

Figure 8D:
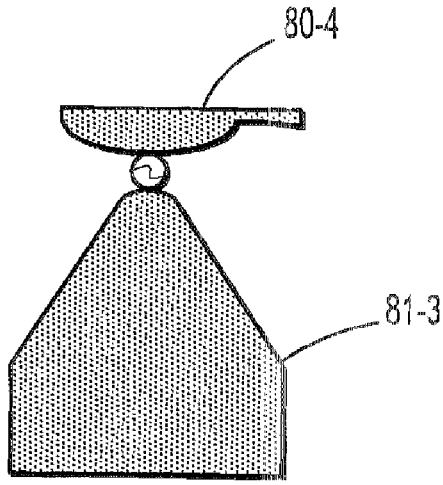
FIG. 8D (PRIOR ART)

In accordance with exemplary embodiments of the invention, improved impedance match over a broad bandwidth can be achieved by modifying the cone element (81-2) to have a polygonal shape, and replacing the cone tip (point) by a edge or smooth arc, to form element (81-3), as well as replacing the planar strip (80-3) with an asymmetrical shaped element (80-4) having a polygonal shape with an additional extended elongated strip, such as shown in FIG. 8D. FIG. 8D depicts an exemplary framework that can be further modified/refined using structures and methods described herein to further reduce antenna size while providing wide operating bandwidth. For illustrative purposes, exemplary embodiments of the invention will be described in detail hereafter with regard to low-profile multi-mode embedded antenna designs for integration within display units of portable laptop computers (e.g., IBM ThinkPad computer), but nothing herein shall be construed as limiting the scope of the invention.

Figure 1A:
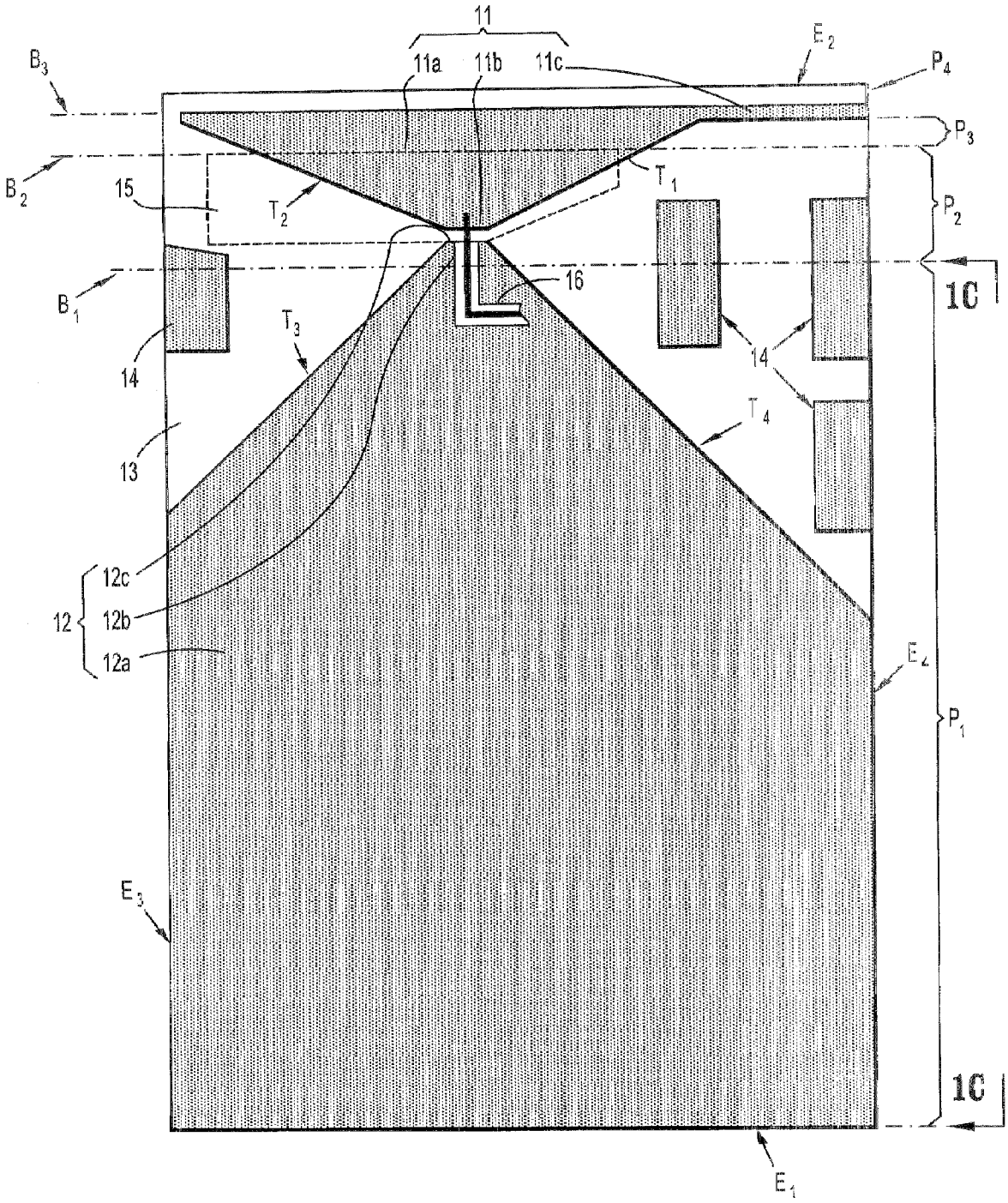
FIGS. 1A~1D schematically illustrate a multi-mode antenna according to an exemplary embodiment of the invention.
Figure 1B:
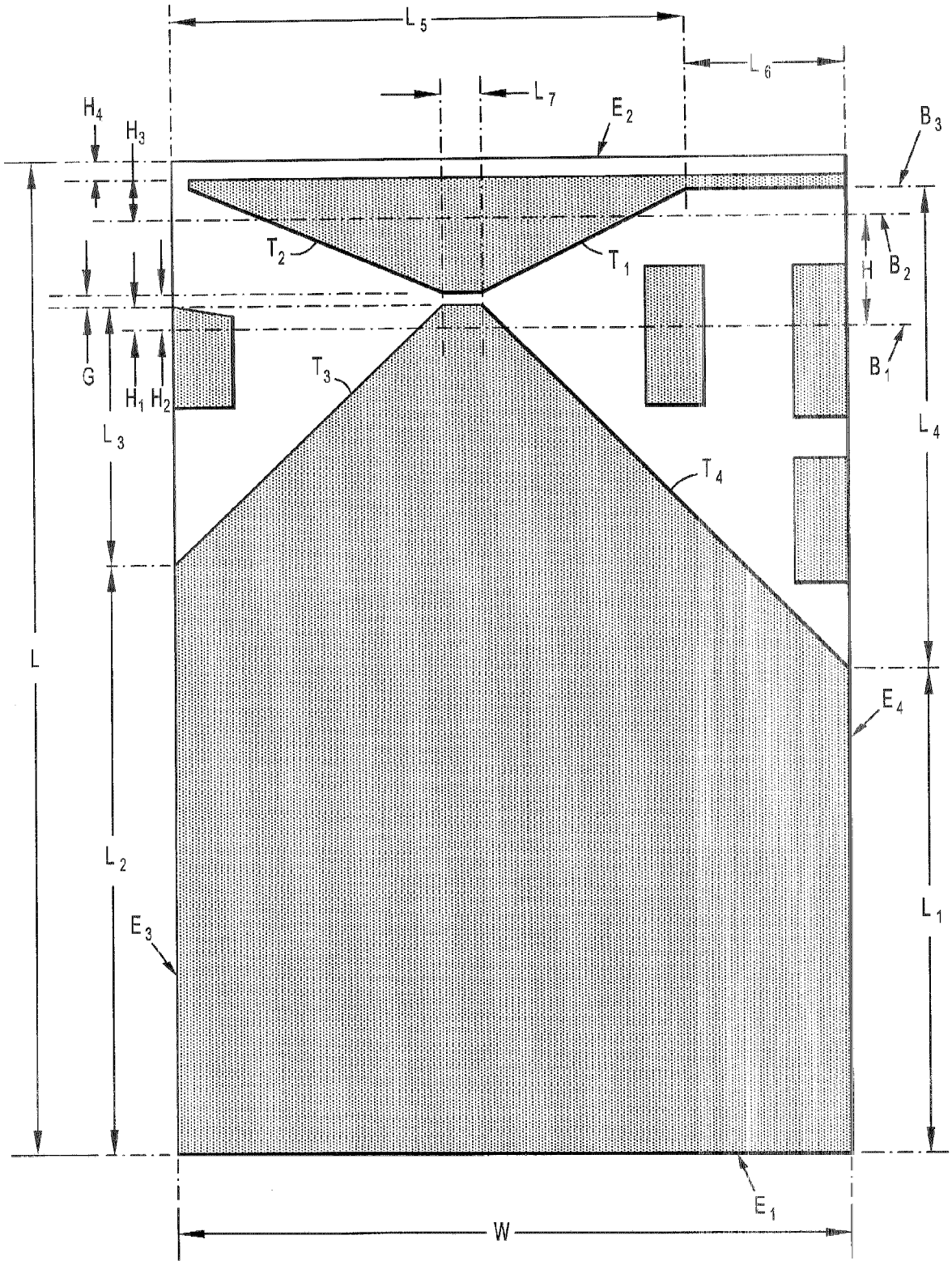

FIGS. 1A~1D schematically illustrate a low-profile multi-mode antenna according to an exemplary embodiment of the invention. More specifically, FIG. 1A is a schematic plan view of a low-profile multi-mode antenna structure (10) comprising a first radiating element (11) (or "primary radiating element"), a second radiating element (12) (or "secondary radiating element"), and a plurality of supporting structures (14), which are patterned or otherwise formed from a thin film of metallic material (e.g., copper) on a first (top) surface of a planar insulative/dielectric substrate (13). In addition, a metallic back plate (15) (which is depicted in phantom in FIG. 1A) is patterned or otherwise formed from a thin film of metallic material on a second (back) surface of the substrate (13). FIG. 1B illustrates dimensional parameters of the exemplary multi-mode antenna structure (10), which will be discussed in further detail below.

Figure 1C:
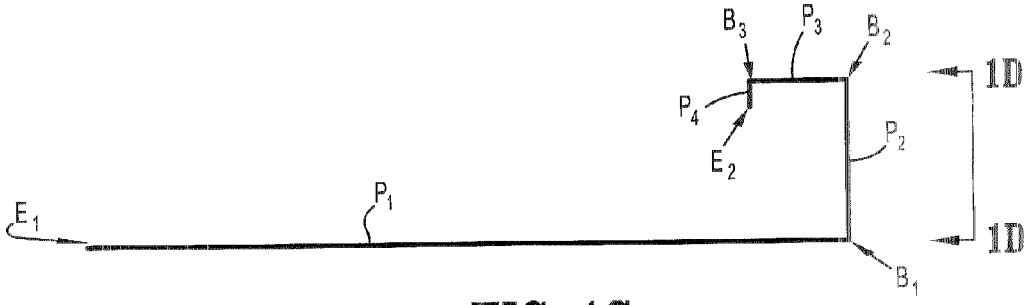

The substrate (13) can be a flexible substrate (or "flex") made from a polyimide material, which is rectangular-shaped with a length L and width W. FIG. 1A depicts a planar multi-mode antenna structure (10) which can be embedded within a wireless device depending the space limitations, etc. For embedded laptop applications, the multi-mode antenna (10) can be bent along bending lines B1, B2 and B3 to form a more compact profile for integration within a display unit of a laptop computer, for example (as will be discussed below with reference to FIG. 2). In particular, FIG. 1C is a schematic side view illustration of the multi-mode antenna (10) of FIG. 1A taken along line 1C-1C when bent at successive right angles along bending lines B1, B2 and B3.

Figure 1D:
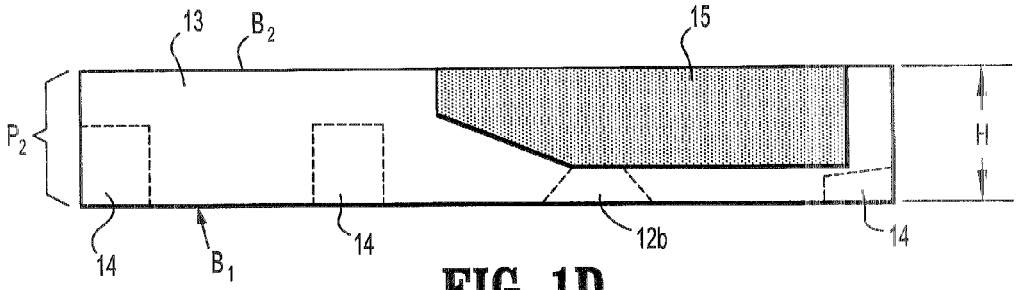

In this bent configuration, the antenna substrate (13) comprises a first substrate portion (P1) (or first horizontal portion) bounded between a first substrate edge E1 and bending line B1, a second substrate portion (P2) (or second vertical portion) bounded between bending lines B1 and B2, a third substrate portion (P3) (or third horizontal portion) bounded between bending lines B2 and B3, and a fourth substrate portion (P4) (or fourth vertical portion) bounded between bending line B3 and a second substrate edge E2. The rectangular copper pads (14) provide support to maintain the structure of the multi-mode antenna (10) after bending, while having negligible effects on antenna performance. FIG. 1D is a schematic view of a back-side surface of the substrate (13) along line 1D-1D in FIG. 1C between bending lines B1 and B2, which illustrates the metallic back plate (15) pattern disposed thereon on the back surface of substrate portion P2.

In the exemplary embodiment of FIGS. 1A~1D, the first and second radiating elements (11) and (12) form an antenna structure that is based on a modified planar discone antenna (or modified planar bi-conical antenna) framework such as discussed above with reference to FIGS. 8C and 8D, to provide a compact antenna structure with broad operating bandwidth for wideband applications.

In general, the first radiating element (11) has an asymmetrical-shaped pattern comprising a first portion (11*a*) which has a polygon shape, and a second portion (11*c*) which is an elongated strip pattern extending from the first portion (11*a*) along an upper edge of the first radiating element (11). In particular, the first portion (11*a*) has a polygonal shape defined, in part, by an upper edge of length L5 along bending line B3 (see, FIG. 1B), and tapered edges T1, T2 that converge toward and connect to respective ends of a bottom edge (11*b*) (with Length L5) of the first radiating element (11). The elongated metal strip (11*c*) extends at a length L6 from a top side of the first portion (11*a*) along the bending line B3.

Furthermore, the second radiating element (12) generally has an asymmetrical-shaped pattern defined by a bottom edge of length W that extends along the entire substrate edge E1, a side edge that extends a length L1 along the substrate edge E4 from the bottom edge, a side edge that extends a length L2 along the substrate edge E3 from the bottom edge, and tapered edges T3, T4 that extend from respective side edges E3 and E4 of the substrate (13) and which converge toward, and connect to, respective ends of an upper edge (12*c*) of length L7.

The edges (11*b*) and (12*c*) of the first and second radiating elements (11) and (12) are aligned to each other and separated by a gap distance G. When the substrate is bent along bending line B1, the second radiating element (12) comprises a first portion (12*a*) disposed on substrate portion P1 and a second portion (12*b*) (or cone tip region) disposed on the second substrate portion P2, wherein the edge (11*b*) of the first radiating element is disposed at a height H1 above the first portion (12*a*) of the second radiating element (12) from the bending line B1. The first radiating element (11) is fed by a probe (inner conductor) extended from a 50Ω coaxial line (16), for example, wherein the probe is aligned with the mid-point of the bottom edge (11*c*). The outer ground shield of the coaxial cable (16) is electrically connected to the ground element (12) via solder connections.

Essentially, the first and second radiating elements (11) and (12) can be viewed as forming a modified planar bi-conical antenna or a modified planar discone antenna structure. For instance, the first radiating element (11) can be viewed as asymmetrical-shaped element comprising a modified planar cone element (i.e., modified to have extended strip (11*c*) and cone tip in the form of the edge (11*b*)) or can be viewed as a modified planar disc element (i.e., modified to include cone-shaped portion (11*a*) formed over a length portion L5 of a planar disc strip element of total length L5+L6). Moreover, the second radiating element (12) can be viewed as an asymmetrically-shaped element comprising a modified planar cone element having a cone tip in the form of an edge (12*c*). The first and second radiating elements (11) and (12) are sized and shaped to provide a wideband impedance match and low profile structure.

The first radiating element (11) provides the primary radiation of the multi-mode antenna (10) and is essentially the tuning element such that small changes in the dimensions of the first radiating element (11) significantly affect the operating frequency of the multi-mode antenna (10) and the impedance matching. The second radiating element (12) is a secondary radiating element which provides little or insubstantial radiation such that the second radiating element (12) can be essentially considered a "ground" (although the antenna element (12) should not be connected directly to metallic/grounded elements when disposed in a portable device). The dimensions of the second radiating element, however, have a significant affect on the impedance match at the lower frequencies of the operating bandwidth. The second radiating element (12) is sized and shaped to enable reduction of the height of the primary radiating element (11) of the multi-mode antenna (10). The dimensions of the elongated strip element (11*c*) of the first radiating element (11) can be tuned to adjust the impedance match of the antenna, especially at the lower frequencies in the operating bandwidth. A broadband impedance transformer is achieved by virtue of the cone tip portions of elements (11) and (12) being formed as edges (11*b*) and (12*c*). The gap G significantly controls the impedance matching, particularly at higher frequencies. The feed point, Dl, is preferably located at approximately the midpoint of the bottom edge (11*b*) of the upper polygon radiating element (11). The location of the feed point also affects the impedance matching.

Figure 2:
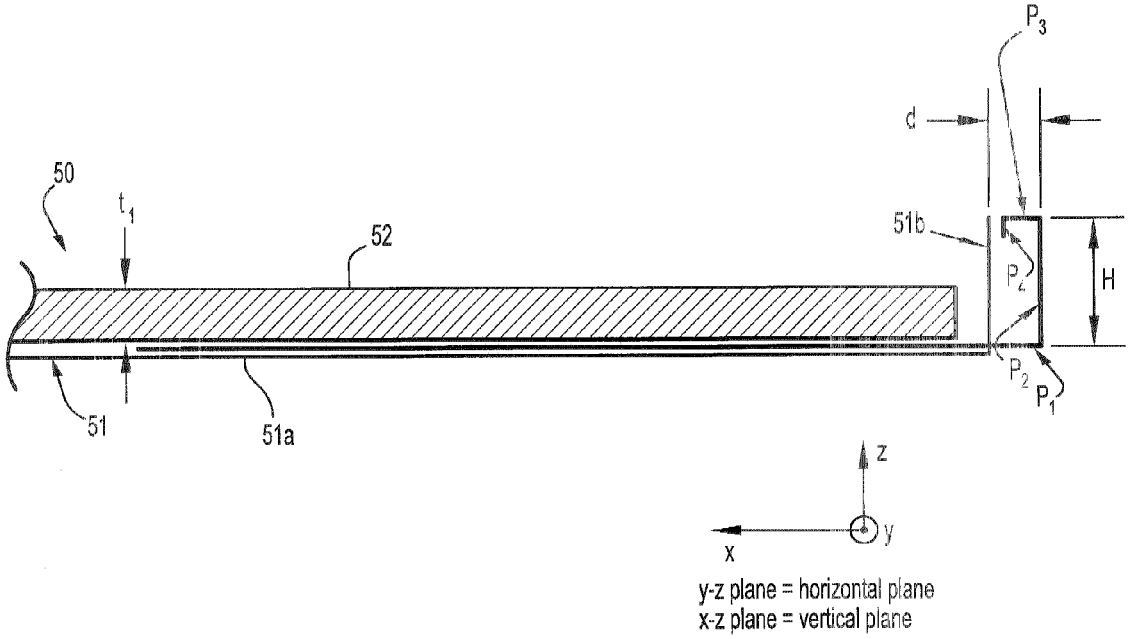
FIG. 2 schematically illustrates a method for integrating a multi-mode antenna into a display unit of a laptop computer according to an exemplary embodiment of the invention.

The exemplary multi-mode antenna (10) depicted in FIGS. 1A~1D can be embedded within a display unit of a laptop computer using a technique schematically illustrated in FIG. 2, according to an exemplary embodiment of the invention. FIG. 2 is a side schematic view of a laptop display unit (50) comprising an embedded multi-mode antenna structure, such as the exemplary multi-mode antenna (10) depicted in FIGS. 1A~1D. The display unit (50) comprises a display cover (51) and a display panel (52) (e.g., LCD). The display cover (51) comprises a back portion (51*a*) and sidewall portion (51*b*). The display panel (52) is shown having a thickness, t1, and is secured to the display cover (51) using a metallic display panel frame (not shown), such that a small space is formed between a backside of the display panel (52) and the back panel portion (51*a*) of the display cover (51). The display cover (51) may be formed of a metal material (such as magnesium), a composite material (CFRP) or a plastic material (such as ABS). Depending on the laptop design, a shielding plate (not shown) may be disposed on the backside of the display panel (52) for purposes of electromagnetic shielding.

As depicted in FIG. 2, the multi-mode antenna (10) structure as depicted in FIG. 1C can be integrated in the laptop display unit (50) by interposing the first substrate portion P1 of the antenna substrate (13) between the backside of the display panel (52) and the inner surface of the back panel (51*a*) of the display cover (51). Moreover, the first substrate portion P1 is disposed between the backside of the display panel (52) and the inner surface of the back panel (51*a*) of the cover (51) such that the second portion (12*a*) of the secondary radiating element (12) does not contact metal objects. When the display cover (51) is formed of metal, insulation tape can be used to cover the secondary radiating element portions (12*a*) and (12*b*) to ensure no contact with the metal cover or other metallic or ground elements of the display unit (50).

Further, a portion of the sidewall (51*b*) of the display cover (51) is removed so that substrate portions P2, P3 and P4, as well as an end region of substrate portion P1, protrude past an outer surface of the sidewall (51*b*) of the display cover (51) at a distance d. As depicted in FIG. 2, the height H of the second substrate portion between bending lines B1 and B2 is selected so that the antenna structure does not extend past the upper surface of the display cover (51). It is preferable for the first radiating element (11) to be disposed above the surface plane of the display (52) to achieve high radiation efficiency.

For purposes of testing and determining electrical properties and characteristics of a low-profile multi-mode antenna according to an exemplary embodiment of the invention, a prototype antenna was constructed based on the exemplary multi-mode antenna framework depicted in FIGS. 1A~1D to provide an operating bandwidth of about 1 GHz to about 11 GHz, wherein the prototype was embedded in a display unit of a laptop application such as depicted in FIG. 2. The prototype antenna substrate (13) was made from flexible polyimide substrate material with 1 oz copper patterned to form the antenna elements (11) and (12) and support structures (14). Referring to FIG. 1B, the polyimide substrate (13) was formed with dimensions L=105 mm, W=70 mm and thickness of 6 mils. Moreover, the following prototype multi-mode antenna was constructed with the following dimensions: L1=47 mm, L2=67 mm, L3=23 mm, L4=55 mm, L5=46 mm, L6=22 mm, L7=4 mm, H=12 mm, H1=3 mm, H2=4 mm, H3=4 mm, H4=2 mm, and G=1 mm.

The prototype multi-mode antenna of was installed in an IBM ThinkPad laptop computer having a magnesium display cover, in the upper right region of the display unit using the methods depicted in FIG. 2. The display unit of the computer had a cover side wall of a height of 15 mm (inside). The cover side wall had a slot formed where the prototype multi-mode antenna was installed. An RF feed cable of a length of 55 mm was installed through the metal cover to feed the multi-mode antenna. The minimum distance between the frame of the display panel to the antenna (bottom) was about 3 mm. The thickness, t1, of the display panel (51, FIG. 2) was about 5 mm. The prototype multi-mode antenna was located/orientated within the display unit (50) housing as depicted in FIG. 2. The multi-mode antenna was disposed such that the second substrate portion P2 extended past the cover sidewall (51*b*) at a distance d=5 mm.

Figure 3:
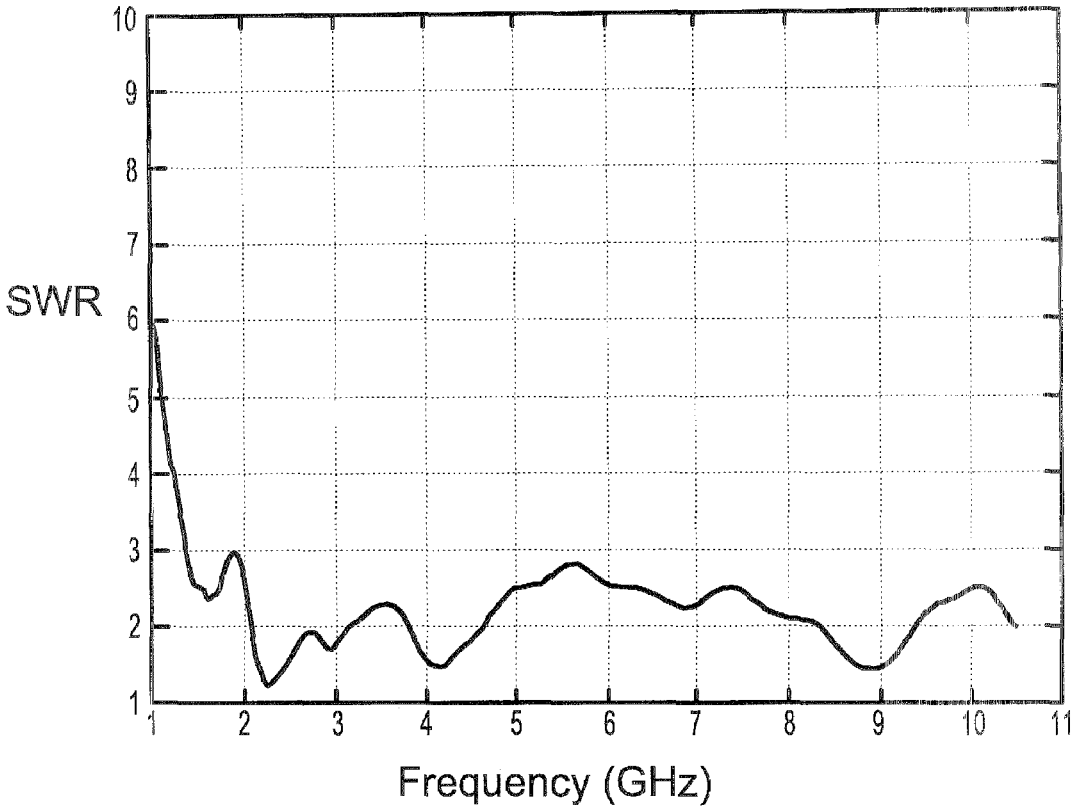
FIG. 3 graphically illustrates SWR (standing wave ratio) measurements that were taken over a frequency range of 1~11 GHz for an exemplary first prototype embedded multi-mode antenna that was constructed based on the exemplary framework depicted in FIGS. 1A~1D, and embedded in a display unit of laptop computer having a magnesium display cover.

Voltage Standing wave ratio (VSWR or simply SWR) and radiation measurements were performed with the prototype multi-mode antenna mounted in the prototype laptop in an anechoic chamber. FIG. 3 graphically illustrates the measured SWR of the prototype multi-mode antenna installed in the laptop display over a frequency range of 1 GHz-11 GHz. As shown in FIG. 3, the exemplary prototype multi-mode antenna provided sufficient SWR bandwidth (3:1) to cover multiple bands, inclusive of the GPS band (1.5 GHz), the PCS band (1800/1900), the 2.4-2.5 GHz ISM band, the 5 GHz WLAN bands, and the UWB band (3.1 GHz-10.6 GHz). The SWR was measured with about 2 inch low loss coaxial cable. In an actual laptop application, the coaxial cable is typically more than 50 cm long and has more than 1 dB loss at 2.4 GHz frequency due to its small diameter, and thus, the SWR at the transceiver is 2:1 or better.

Figure 4:
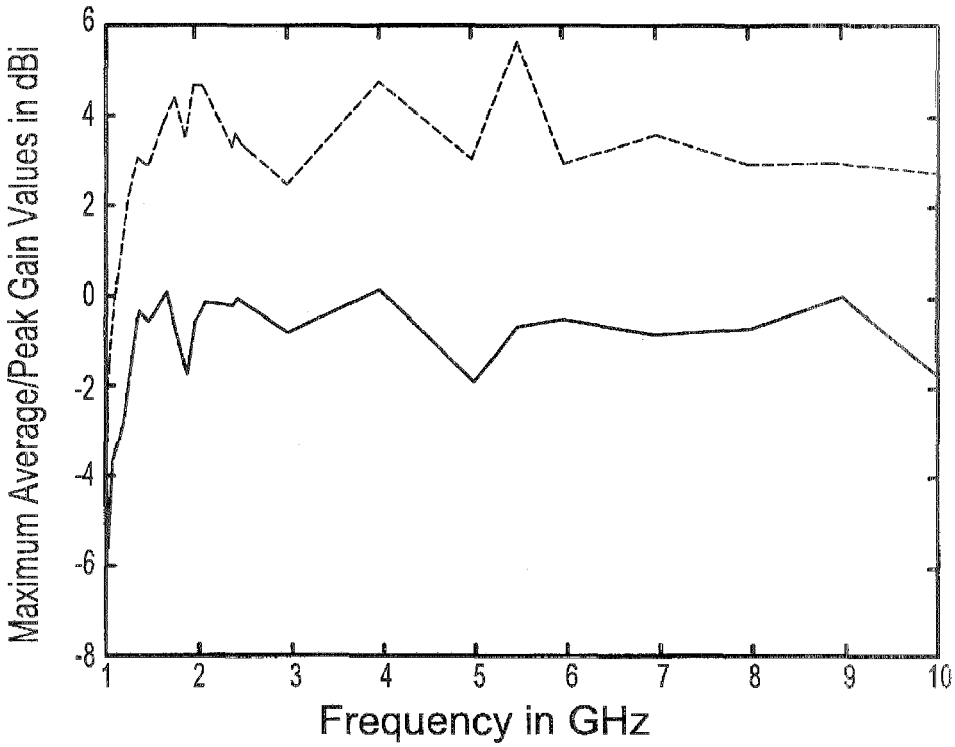
FIG. 4 graphically illustrates measurements of peak gain and average gain (in dBi) that were taken over a frequency range of 1~10 GHz for the exemplary first prototype embedded multi-mode antenna.

FIG. 4 graphically illustrates peak gain and average gain (in dBi) measurements that were taken over a frequency range of 1~10 GHz for the exemplary prototype antenna. The dotted line illustrates the measured peak gain and the solid curve illustrates the average gain of the prototype in the metal display cover over the horizontal plane when the laptop display unit was opened 90 degrees with respect to the base unit. The average gain is defined over 360 degrees in the horizontal plane (y-z plane, FIG. 2). The measured peak gain and average gain values were found to not vary much across the bands. The peak and the average gains were, respectively, higher than 0 dBi and −4 dBi, which are sufficient for all the wireless standards.

The measured gain values for the prototype multi-mode antenna were found to be much better than those obtainable with typical laptop antennas. The exemplary prototype multi-mode antenna was tested in other laptop display units having display covers formed of ABS and CFRP material. The measured average and peak gains of the prototype multi-mode antenna in the ABS and CFRP laptop display covers were found to be slightly higher and slightly lower, respectively, as compared to the magnesium display cover.

Figure 5A:
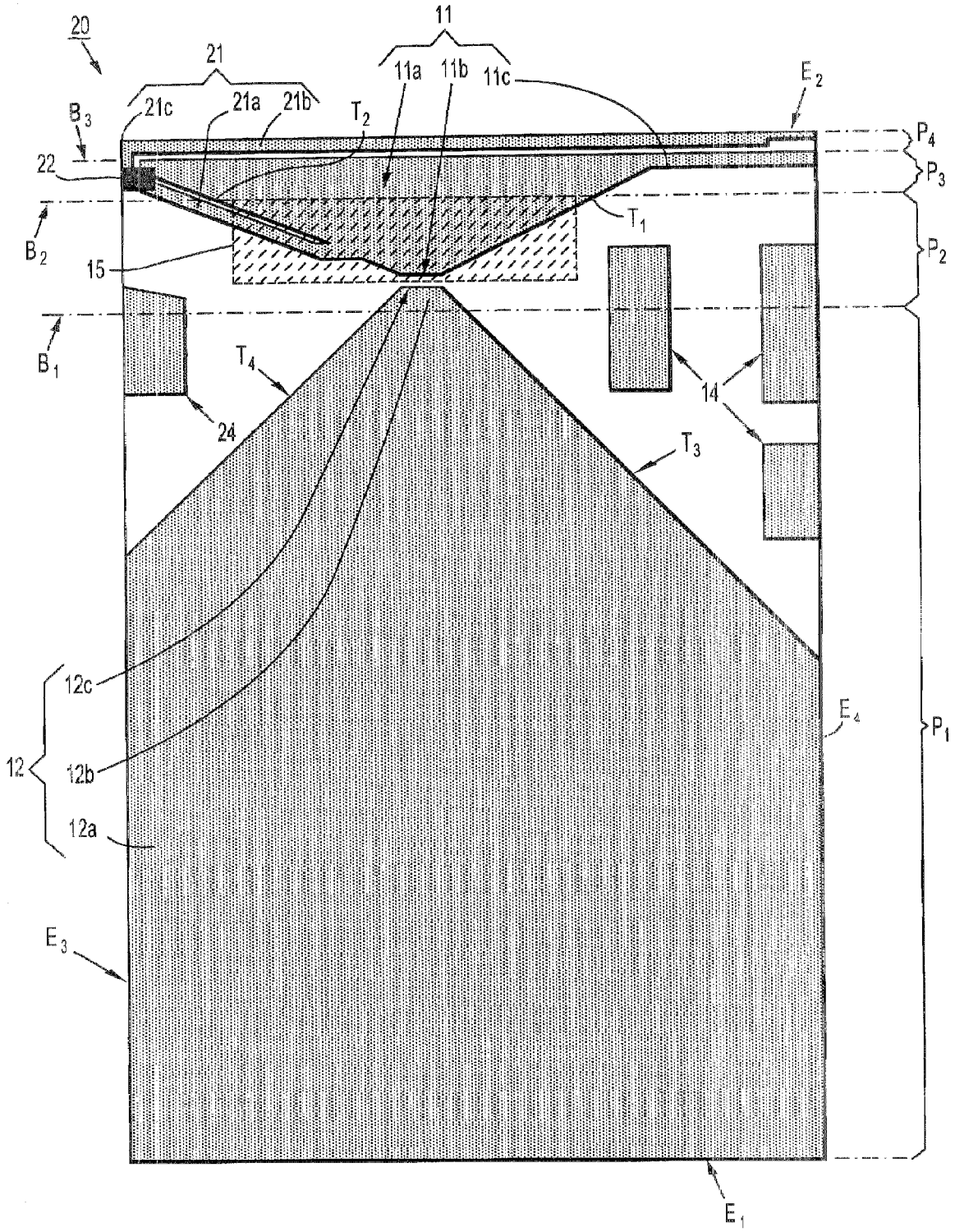
FIGS. 5A and 5B schematically illustrate a multi-mode antenna according to another exemplary embodiment of the invention.
Figure 5B:
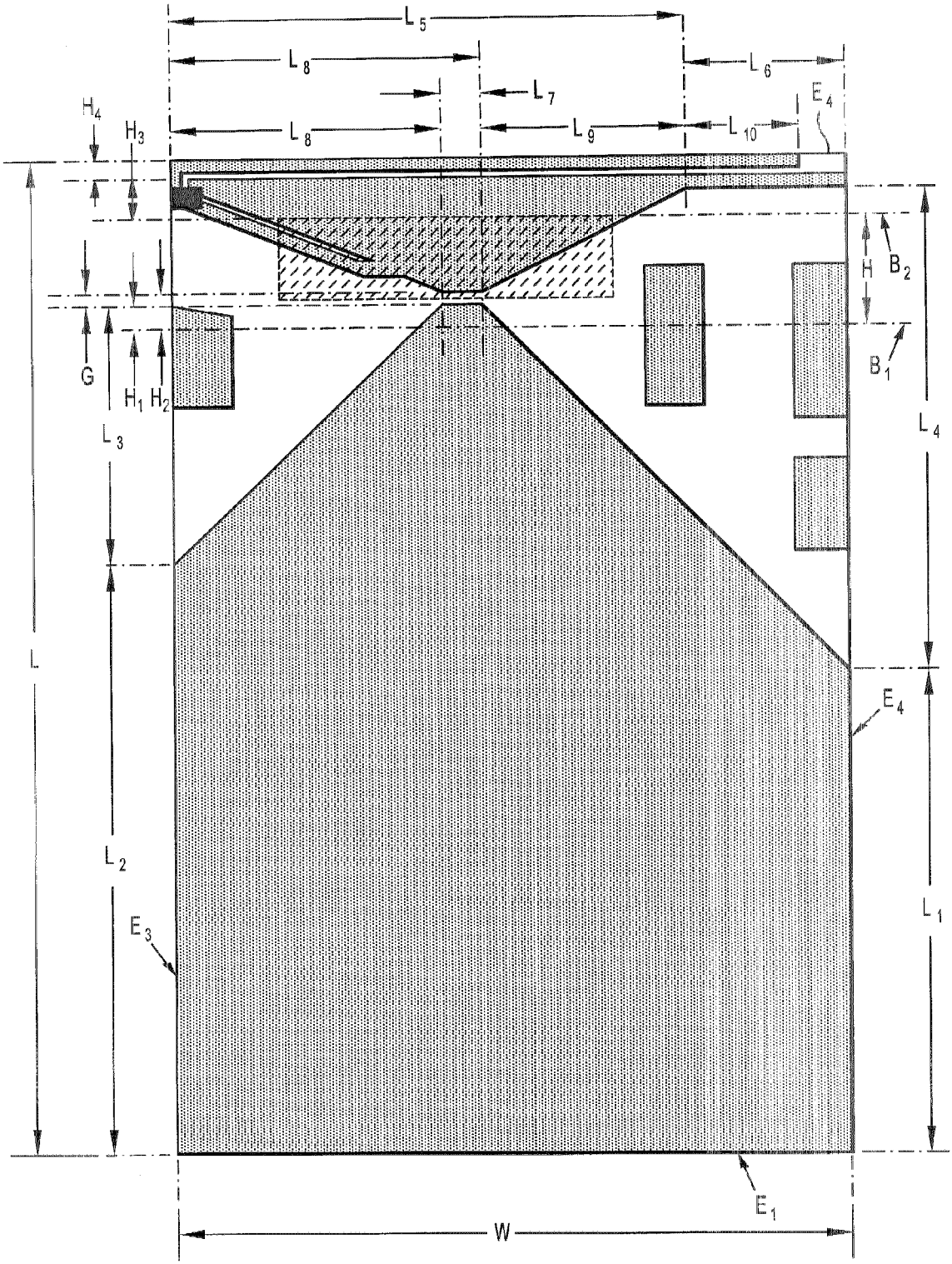

FIGS. 5A and 5B schematically illustrate a low-profile multi-mode antenna according to another exemplary embodiment of the invention. More specifically, FIGS. 5A and 5B are schematic plan views of a low-profile multi-mode antenna structure (50) having first and second radiating elements (11) and (12) with structures similar to those of the exemplary multi-mode antenna (10) as discussed above providing wideband operation in the 1.5-10.6 GHz band. The exemplary multi-mode antenna (20) further comprises a third planar radiating element (21) providing operation in the 800/900 MHz band.

In particular, the third planar radiating element (21) is a branch radiating element that is connected to the primary radiating element (11) in proximity to the feed point at edge (11*b*). The branch radiating element (21) comprises a first elongated strip portion (21*a*), a second elongated strip portion (21*b*) and a connecting side portion (21*c*). The first elongated strip portion (21*a*) extends along the tapered edge T2 of the first radiating element (11) and is connected to the second elongated strip portion (21*b*) by the connecting side portion (21*c*). The second elongated strip portion (21*b*) extends along the upper edge of the first radiating element (11) along bending line B3 and terminates at an open end near the substrate edge E4.

The total length of elements (21*b*) and (21*c*) of the branch radiating element (21) determines the 800/900 MHz band resonant frequency. A shorting element (22) can be used to provide a short connection between the first radiating element (11) and a point on the branch radiating element (21) to effectively change the electrical length of the branch radiating element (21) and thus tune the resonant frequency of the branch radiating element (21). The multi-mode antenna (20) can be formed using a flexible substrate (13) that can be bent along bending lines B1, B2 and optionally B3 to form an antenna profile such as illustrated in FIG. 1C.

For purposes of testing and determining electrical properties and characteristics of a low-profile multi-mode antenna having the framework as depicted in FIGS. 5A and 5B, a prototype multi-mode antenna was constructed to provide an operating bandwidth of about 800 MHz to 10.6 GHz, wherein the prototype was embedded in a display unit of a laptop application such as depicted in FIG. 2. The prototype antenna substrate (13) was made from flexible polyimide substrate material with 1 oz copper patterned to form the antenna elements (11), (12), (21) and support structures (14).

Referring to FIG. 5B, the polyimide substrate (13) was formed with dimensions L=105 mm, W=70 mm and thickness of 6 mils. Moreover, the following prototype multi-mode antenna was constructed with the following dimensions: L1=52 mm, L2=62 mm. L3=28 m, L4=50 mm, L5=54 mm, L6=17 mm, L7=4 mm, L8=28 mm, L9=21 mm and L10=12 mm, H=12 mm, H1=3 mm, H2=4 mm, H3=4 mm, H4=2 mm, and G=1 mm. The prototype multi-mode antenna was located/orientated within the display unit (50) housing such as schematically depicted in FIG. 2. The multi-mode antenna was disposed such that the second substrate portion P2 extended past the cover sidewall (51*b*) at a distance d=5 mm.

Figure 6:
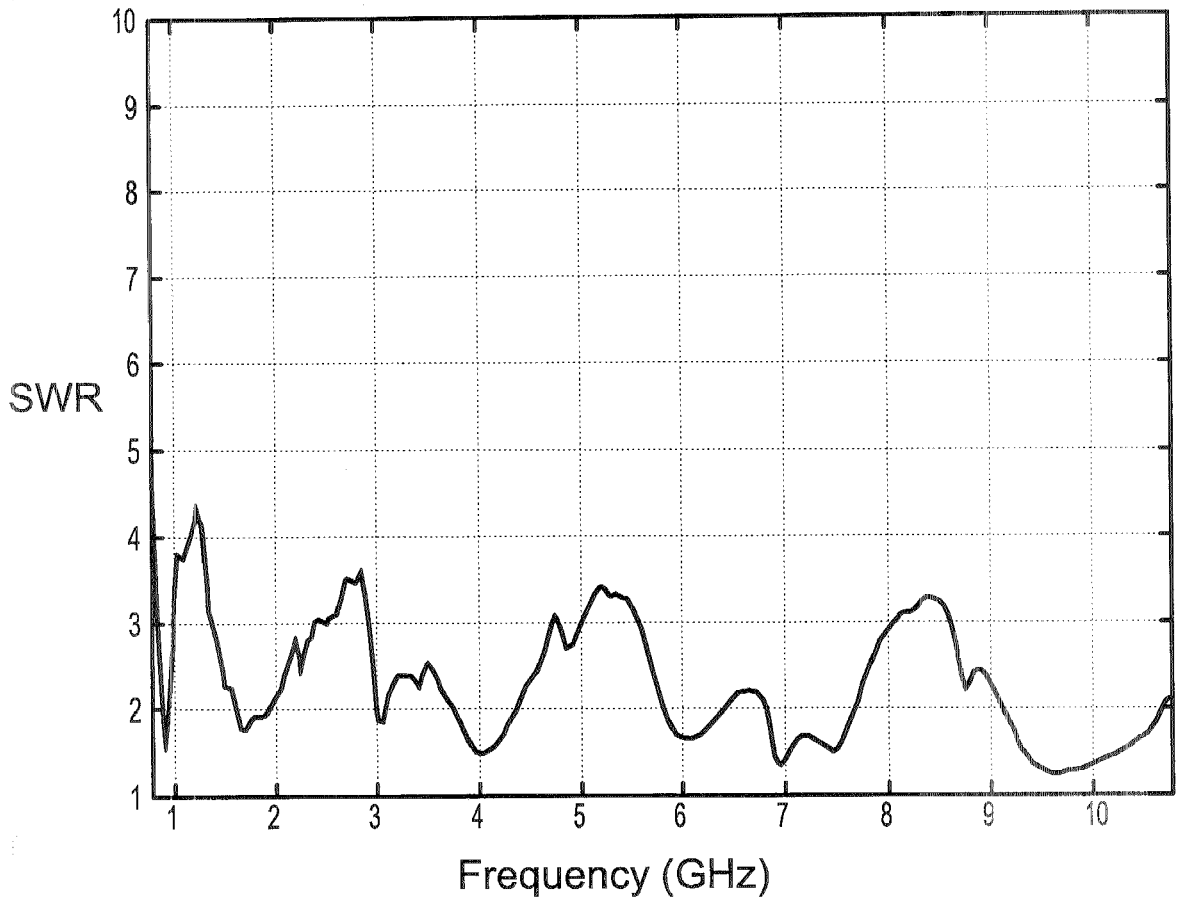
FIG. 6 graphically illustrates SWR (standing wave ratio) measurements that were taken over a frequency range of 0.8 GHz~11 GHz for an exemplary second prototype embedded multi-mode antenna that was constructed based on the exemplary framework depicted in FIGS. 5A and 5B, and embedded in a display unit of laptop computer having a magnesium display cover.

Voltage Standing wave ratio measurements were performed the prototype multi-mode antenna mounted in the prototype laptop display having a magnesium display cover. FIG. 6 graphically illustrates the measured SWR of the prototype multi-mode antenna over a frequency range of 0.8 GHz-11 GHz. FIG. 6 illustrates that the prototype multi-mode antenna was resonant in the 800/900 MHz bands. The branch radiating element (21) has some effect on the 1.5-10.6 GHz band, which can be minimized or reduced by increasing the gap between the first radiating element (11) and the branch radiating element (21). It is to be appreciated that the exemplary multi-mode antenna (20) provides another low cost antenna design that effectively covers all the wireless communications standards from 800 MHz to 10.6 GHz.

Figure 7:
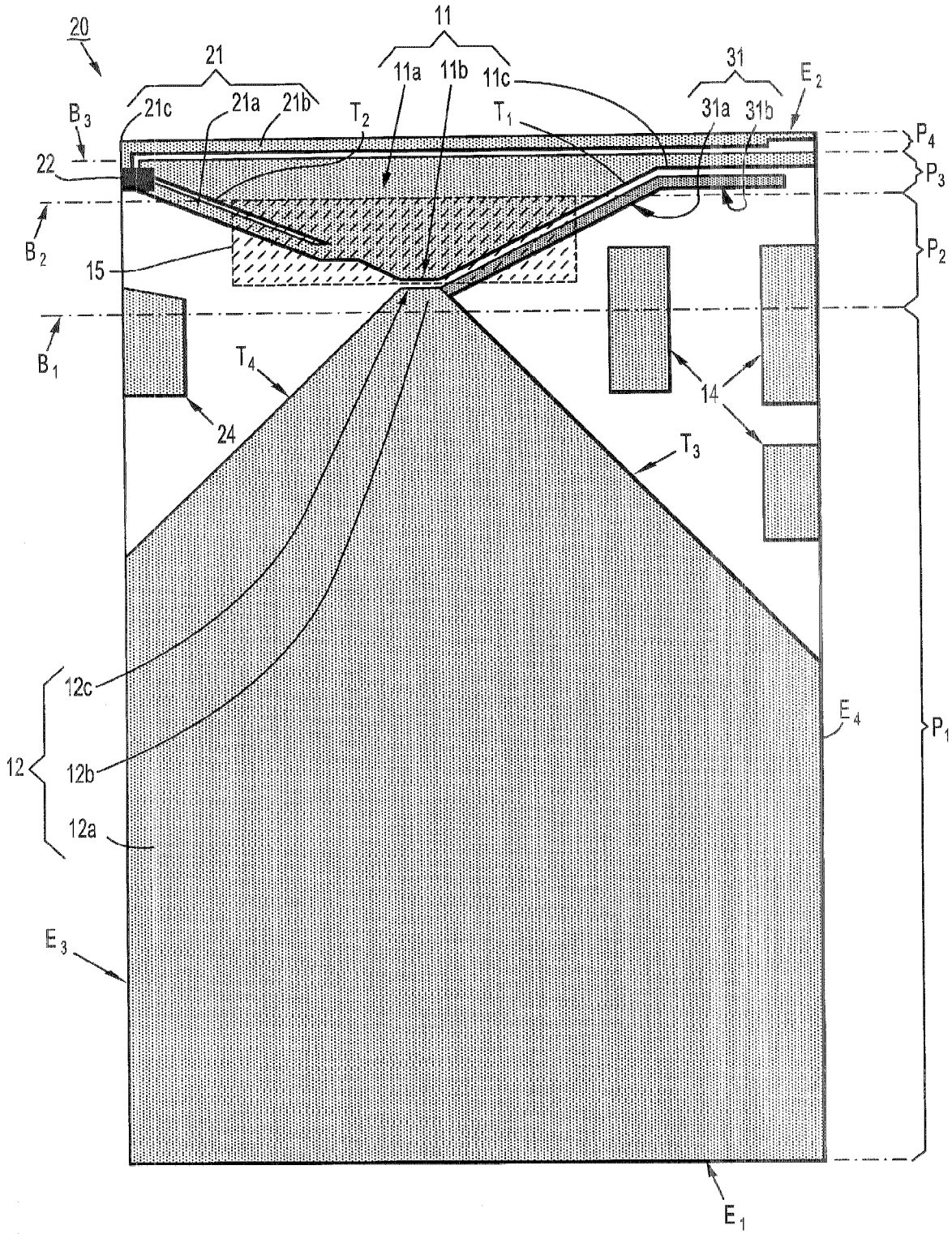
FIG. 7 schematically illustrates a multi-mode antenna according to another exemplary embodiment of the invention.

FIG. 7 schematically illustrates a low-profile multi-mode antenna according to another exemplary embodiment of the invention. More specifically, FIG. 7 illustrates a low-profile multi-mode antenna structure (30) having first, second and third radiating elements (11), (12) and (21) with structures similar to those of the exemplary multi-mode antenna (20) as discussed above. The exemplary multi-mode antenna (30) further comprises a fourth planar radiating element (31) to further improve the second band performance for operation in the 800/900 MHz band coverage.

In particular, the fourth planar radiating element (31) is a coupled radiating element that is connected to the secondary radiating element (12) at the edge (12*c*) in proximity to the feed point at edge (11*b*). The coupled radiating element (31) comprises a first elongated strip portion (31*a*) that extends along the tapered edge T3 of the first radiating element (11) and a second elongated strip portion (31*b*) that extends along the elongated strip portion (11*c*) of the primary radiating element (11) and terminates at an open end near the substrate edge E4. The electrical length of the coupled radiator can be selected to have a resonant frequency in the 800/900 MHz band to provide wider bandwidth of operation in such band.

It is to be understood that the exemplary wideband, multi-mode antennas described above are merely illustrative embodiments, and that one of ordinary skill in the art can readily envision other multi-mode antenna frameworks that can be implemented based on the teachings herein. For instance, the first (primary) radiator element can be modified to have varying types of asymmetrical shapes based on, e.g., the available space, desired antenna height, operating frequency range, degree of radiation at certain frequencies in the operating band, etc. With planar radiators, it is believed that most radiation occurs near the edges of the planar radiator, whereby regions of the radiator edges with shaper discontinuities provide increased radiation points, whereas planar radiators with smooth edges provide more uniform radiation along the edges. Asymmetrical shapes tend to increase the operating bandwidth. The asymmetrical structures are believed to prevent cancellation of the current distributions over the elements.

Although the shapes of the secondary radiating elements do not significantly affect antenna performance, the tapered shape of such elements enables wideband operation. Smooth curved edges of the secondary radiating element can be used to provide somewhat increased performance with respect to wider bandwidth, although as noted above, the secondary radiating elements contribute little to the radiation and large dimensional changes provide small changes in antenna electrical characteristics.

Although illustrative embodiments have been described herein with reference to the accompanying drawings, it is to be understood that the present invention is not limited to those precise embodiments, and that various other changes and modifications may be affected therein by one skilled in the art without departing from the scope of the invention.

What is claimed is:

1. An antenna, comprising:

a planar substrate having first and second opposing substrate surfaces;

a first planar radiating element and a second planar radiating element formed on the first surface of the planar substrate;

wherein the first planar radiating element has an asymmetrically-shaped pattern comprising a first polygon pattern and an elongated strip pattern extending from the first polygon pattern, wherein the first planar radiating element comprises a first edge that defines a part of the first polygonal pattern and a second edge that defines a part of both the first polygon pattern and the elongated strip pattern;

wherein the second planar radiating element has an asymmetrically-shaped pattern comprising a second polygon pattern defined in part by a first edge of the second planar radiating element wherein the first and second planar radiating elements are disposed on the first surface of the planar substrate such that the first edge of the first planar radiating element is adjacent to, and spaced apart from, the first edge of the second planar radiating element.

2. The antenna of claim 1, wherein the antenna is a planar discone antenna where the first planar radiating element is an asymmetrically-shaped planar disc element and wherein the second planar radiating element is an asymmetrically-shaped planar cone element having a cone tip defined by the first edge of the second planar radiating element.

3. The antenna of claim 1, wherein the antenna is a planar bi-conical antenna where the first planar radiating element is an asymmetrically-shaped planar cone element having a first cone tip defined by the first edge of the first planar radiating element and wherein the second planar radiating element is an asymmetrically-shaped planar cone element having a second cone tip defined by the first edge of the second planar radiating element.

4. The antenna of claim 1, wherein the planar substrate is a flexible substrate that is bent along at least a first bending line and a second bending line to define a first substrate portion, a second substrate portion and a third substrate portion, which are non-coplanar, wherein the first bending line separates the first and second substrate portions and wherein the second bending line separates the second and third substrate portions.

5. The antenna of claim 4, wherein the first bending line extends through the second planar radiating element, wherein the second bending line extends through the first planar radiating element, and wherein the first edges of the first and second planar radiating elements are disposed in the second substrate portion.

6. The antenna of claim 4, wherein the first and second substrate portions are substantially orthogonal and wherein the second and third substrate portions are substantially orthogonal.

7. A laptop computer having the antenna of claim 6 embedded in a display unit, where the first substrate portion is disposed between a display panel and display cover, and wherein the second substrate portion is disposed external and substantially parallel to a side wall of the display cover.

8. The antenna of claim 4, wherein the flexible substrate is bent along a third bending line that extends along the second edge of the first planar radiating element.

9. The antenna of claim 1, further comprising a metallic back-plate pattern disposed on a second surface of the substrate and aligned to a portion of the first planar radiating element on the first surface of the planar substrate.

10. The antenna of claim 1, further comprising a single feed probe connected to a mid-point along the first edge of the first planar radiating element.

11. The antenna of claim 1, wherein the antenna operates over a bandwidth of about 1 GHz to about 11 GHz.

12. The antenna of claim 1, wherein the antenna operates over a bandwidth of about 0.8 GHz to about 11 GHz.

13. An antenna, comprising:

a planar substrate having first and second opposing substrate surfaces;

a first planar radiating element, a second planar radiating element, and a third planar radiating element formed on the first surface of the planar substrate;

wherein the first planar radiating element has an asymmetrically-shaped pattern comprising a first polygon pattern and an elongated strip pattern extending from the first polygon pattern, wherein the first planar radiating element comprises a first edge and a second edge that define a part of the first polygonal pattern and a third edge that defines a part of both the first polygon pattern and the elongated strip pattern;

wherein the second planar radiating element has an asymmetrically-shaped pattern comprising a second polygon pattern defined in part by a first edge of the second planar radiating element;

wherein the first and second planar radiating elements are disposed on the first surface of the planar substrate such that the first edge of the first planar radiating element is adjacent to, and spaced apart from, the first edge of the second planar radiating element, and wherein the third planar radiating element is an elongated branch element connected to the first planar radiating element, wherein at least a portion of the elongated branch element is disposed adjacent to, and spaced apart from, the second edge of the first planar radiating element.

14. The antenna of claim 13, wherein at least a portion of the elongated branch element is disposed adjacent to, and spaced apart from, at least a portion of the third edge of the first planar radiating element.

15. The antenna of claim 13, wherein the antenna is a planar discone antenna where the first planar radiating element is an asymmetrically-shaped planar disc element and wherein the second planar radiating element is an asymmetrically-shaped planar cone element having a cone tip defined by the first edge of the second planar radiating element.

16. The antenna of claim 13, wherein the antenna is a planar bi-conical antenna where the first planar radiating element is an asymmetrically-shaped planar cone element having a first cone tip defined by the first edge of the first planar radiating element and wherein the second planar radiating element is an asymmetrically-shaped planar cone element having a second cone tip defined by the first edge of the second planar radiating element.

17. The antenna of claim 13, wherein the planar substrate is a flexible substrate that is bent along at least a first bending line and a second bending line to define a first substrate portion, a second substrate portion and a third substrate portion, which are non-coplanar, wherein the first bending line separates the first and second substrate portions and wherein the second bending line separates the second and third substrate portions.

18. The antenna of claim 17, wherein the first bending line extends through the second planar radiating element, wherein the second bending line extends through the first and third planar radiating elements, and wherein the first edges of the first and second planar radiating elements are disposed in the second substrate portion.

19. The antenna of claim 17, wherein the first and second substrate portions are substantially orthogonal and wherein the second and third substrate portions are substantially orthogonal.

20. A laptop computer having the antenna of claim 19 embedded in a display unit, where the first substrate portion is disposed between a display panel and display cover, and wherein the second substrate portion is disposed external and substantially parallel to a side wall of the display cover.

21. The antenna of claim 17, wherein the flexible substrate is bent along a third bending line that extends along the third edge of the first planar radiating element.

22. The antenna of claim 13, further comprising a metallic back-plate pattern disposed on a second surface of the substrate and aligned to a portion of the first planar radiating element on the first surface of the planar substrate.

23. The antenna of claim 13, further comprising a single feed probe connected to a mid-point along the first edge of the first planar radiating element.

24. The antenna of claim 13, wherein the antenna operates over a bandwidth of about 0.8 GHz to about 11 GHz.

25. An antenna, comprising:

a planar substrate having first and second opposing substrate surfaces;

a first planar radiating element, a second planar radiating element, a third planar radiating element and a fourth planar radiating element formed on the first surface of the planar substrate;

wherein the first planar radiating element has an asymmetrically-shaped pattern comprising a first polygon pattern and an elongated strip pattern extending from the first polygon pattern, wherein the first planar radiating element comprises a first edge, second edge and third edge that define a part of the first polygonal pattern, and a fourth edge that defines a part of both the first polygon pattern and the elongated strip pattern;

wherein the second planar radiating element has an asymmetrically-shaped pattern comprising a second polygon pattern defined in part by a first edge of the second planar radiating element;

wherein the first and second planar radiating elements are disposed on the first surface of the planar substrate such that the first edge of the first planar radiating element is adjacent to, and spaced apart from, the first edge of the second planar radiating element, wherein the third planar radiating element is an elongated branch element connected to the first planar radiating element, wherein at least a portion of the elongated branch element is disposed adjacent to, and spaced apart from, the second edge of the first planar radiating element; and wherein the fourth planar radiating element is an elongated coupled element connected to the second planar radiating element, wherein at least a portion of the elongated coupled element is disposed adjacent to, and spaced apart from, the third edge of the first planar radiating element.

26. The antenna of claim 25, wherein at least a portion of the elongated branch element is disposed adjacent to, and spaced apart from, at least a portion of the fourth edge of the first planar radiating element.

27. The antenna of claim 26, wherein the first planar radiating element comprises a fifth edge that defines a part of the elongated strip pattern, and wherein at least a portion of the elongated branch element is disposed adjacent to, and spaced apart from a least a portion of the fifth edge of the first planar radiating element.

28. The antenna of claim 25, wherein the antenna is a planar discone antenna where the first planar radiating element is an asymmetrically-shaped planar disc element and wherein the second planar radiating element is an asymmetrically-shaped planar cone element having a cone tip defined by the first edge of the second planar radiating element.

29. The antenna of claim 25, wherein the antenna is a planar bi-conical antenna where the first planar radiating element is an asymmetrically-shaped planar cone element having a first cone tip defined by the first edge of the first planar radiating element and wherein the second planar radiating element is an asymmetrically-shaped planar cone element having a second cone tip defined by the first edge of the second planar radiating element.

30. The antenna of claim 25, wherein the planar substrate is a flexible substrate that is bent along at least a first bending line and a second bending line to define a first substrate portion, a second substrate portion and a third substrate portion, which are non-coplanar, wherein the first bending line separates the first and second substrate portions and wherein the second bending line separates the second and third substrate portions.

31. The antenna of claim 30, wherein the first bending line extends through the second planar radiating element, wherein the second bending line extends through the first, third and fourth planar radiating elements, and wherein the first edges of the first and second planar radiating elements are disposed in the second substrate portion.

32. The antenna of claim 31 wherein the flexible substrate is bent along a third bending line that extends along the fourth edge of the first planar radiating element.

33. The antenna of claim 30, wherein the first and second substrate portions are substantially orthogonal and wherein the second and third substrate portions are substantially orthogonal.

34. A laptop computer having the antenna of claim 33 embedded in a display unit, where the first substrate portion is disposed between a display panel and display cover, and wherein the second substrate portion is disposed external and substantially parallel to a side wall of the display cover.

35. The antenna of claim 25, further comprising a metallic back-plate pattern disposed on a second surface of the substrate and aligned to a portion of the first planar radiating element on the first surface of the planar substrate.

* * * * *